US005988879A

United States Patent [19]

Bredderman et al.

[11] Patent Number: 5,988,879

[45] Date of Patent: Nov. 23, 1999

[54] FLEXIBLE STORAGE BAG

[76] Inventors: Ted Bredderman; Ginny Bredderman, both of 3 Sunset Dr., Delmar, N.Y. 12054-1113

[21] Appl. No.: 09/119,286

[22] Filed: Jul. 20, 1998

[51] Int. Cl.[6] ..... B65D 30/22; B65D 33/12; B65D 33/16

[52] U.S. Cl. ..... 383/13; 62/457.1; 150/112; 150/113; 383/18; 383/38; 383/61; 383/75; 383/95; 383/110

[58] Field of Search ..... 383/38, 95, 61, 383/110, 75, 18, 13; 150/112, 113, 118; 62/457.1

[56] References Cited

U.S. PATENT DOCUMENTS

| | | | |
|---|---|---|---|
| 188,673 | 3/1877 | Redden | 383/95 |
| 254,440 | 2/1882 | Kurtz | 383/75 |
| D. 294,912 | 3/1988 | Rivera . | |
| D. 369,723 | 5/1996 | McArthur et al. . | |
| D. 372,795 | 8/1996 | Swinford et al. . | |
| 1,509,922 | 9/1924 | Belz | 383/95 |
| 2,324,495 | 7/1943 | Deming . | |
| 2,415,956 | 2/1947 | Mamaux . | |
| 2,494,632 | 1/1950 | Rodin . | |
| 2,610,757 | 9/1952 | Irvine | 383/110 |
| 2,616,467 | 11/1952 | Cicero | 383/95 |
| 2,661,785 | 12/1953 | Daust . | |
| 2,731,182 | 1/1956 | Higgins . | |
| 3,085,612 | 4/1963 | Gobel . | |
| 3,145,908 | 8/1964 | Smith | 383/109 |
| 3,189,074 | 6/1965 | Schaefer . | |
| 3,225,806 | 12/1965 | Pollak et al. | 383/38 |
| 3,279,331 | 10/1966 | Platt | 383/95 |
| 3,428,103 | 2/1969 | Walsh . | |
| 3,507,312 | 4/1970 | Petersen . | |
| 3,746,066 | 7/1973 | McIntyre . | |
| 3,990,495 | 11/1976 | LaBarba . | |
| 3,998,304 | 12/1976 | Edgerton, Jr. et al. | 383/95 |
| 4,197,890 | 4/1980 | Simko . | |
| 4,228,908 | 10/1980 | Tweeton . | |
| 4,282,279 | 8/1981 | Strickland . | |
| 4,401,245 | 8/1983 | Zills . | |
| 4,463,789 | 8/1984 | Leiserson | 383/38 |
| 4,537,313 | 8/1985 | Workman . | |
| 4,570,800 | 2/1986 | Luckett . | |
| 4,578,814 | 3/1986 | Skamser . | |
| 4,708,248 | 11/1987 | Davis . | |
| 4,826,060 | 5/1989 | Hollingsworth . | |
| 4,877,128 | 10/1989 | Strickland | 383/38 |
| 4,892,226 | 1/1990 | Abtahi . | |
| 4,974,709 | 12/1990 | Furlow et al. | 383/61 |
| 4,988,216 | 1/1991 | Lyman . | |
| 5,052,369 | 10/1991 | Johnson . | |
| 5,181,555 | 1/1993 | Chruniak . | |
| 5,297,870 | 3/1994 | Weldon | 383/61 |
| 5,415,305 | 5/1995 | Drake-Tipton et al. . | |
| 5,632,558 | 5/1997 | Baker | 383/75 |
| 5,680,958 | 10/1997 | Mann et al. . | |

*Primary Examiner*—Stephen P. Garbe
*Attorney, Agent, or Firm*—Schmeiser, Olsen & Watts

[57] ABSTRACT

A storage bag formed from a flexible, highly insulative, water repellent, double-faced pile material. The flexible bag includes a main body having an opening in a top portion thereof. A drawstring is provided for closing the opening in the top of the bag, thereby allowing the bag to accommodate various sized containers or objects. A multi-function divider flap is provided that can serve as an insulating cover for a container enclosed within, or protruding out of, the bag, and/or as a divider to vertically or horizontally separate a plurality of different containers or objects within the bag.

18 Claims, 7 Drawing Sheets

FLEXIBLE STORAGE BAG

FIELD OF THE INVENTION

The present invention relates generally to flexible and portable carrying cases or bags. More specifically, the present invention relates to portable carrying cases or bags of an insulated type designed to keep the contents thereof at a temperature above or below the ambient temperature for an extended period of time. The present invention may be used to carry or store a wide variety of objects including containers of food (e.g., a casserole), beverages (e.g., a six-pack of soda or beer), children's toys, baby supplies, clothing, beach articles, and the like.

BACKGROUND OF THE INVENTION

It is commonplace to bring warm or cold foods to picnics, potluck dinners, or other events. Typically, the food is stored in round, square, or oval containers having lids. The containers are generally formed of metal, glass, ceramic ware, or other materials having limited insulative properties. Thus, in order to keep the enclosed foods warm or cold over a period of time, the containers must be further insulated using an insulating container.

Prior art insulating containers tend to be fixed in size and shape (e.g., a rigid cooler), are designed in the size and shape of the particular item to be insulated (e.g., an insulated bottle holder), or include a mechanism which allows the container to be collapsed from a first predetermined shape and size to a second predetermined shape and size. Such prior art insulating containers, however, generally have limited flexibility, both structurally, and in terms of the types of containers or objects that can be enclosed therein.

One objective of the present invention, therefore, is to provide an insulating bag formed of a highly insulative fabric material.

Another objective of the present invention is to provide an insulating bag which is configured to completely surround a container with insulative material in order to minimize heat transfer to or from the container.

Another objective of the present invention is to provide a flexible, light weight bag that is capable of accommodating containers or objects having a wide variety of sizes and shapes.

SUMMARY OF THE INVENTION

In order to accomplish these and other objectives, the present invention provides a storage bag fabricated from a flexible, highly insulative, water repellent, double-faced pile material. The flexible bag includes a main body having an opening in a top portion thereof. A drawstring is provided for closing the opening in the top of the bag, thereby allowing the bag to accommodate various sized containers or objects.

The flexible storage bag of the present invention additionally includes an insulative combination cover and divider flap, preferably formed from the same highly insulative, water repellent, double-faced pile material as the bag. The flap may be used to cover and insulate a container stored within the bag, to secure objects within the bag, to expand the usable storage area of the bag, or to create two distinct areas within the bag. For example, because of the insulative properties of the divider flap, it can be used to separate warm and cold foods within the bag. Further, since the flap is made from a water-repellent material, the flap can be used to divide wet items from dry items.

The flexible storage bag additionally includes carrying straps which cross under the bag to provide extra strength and security. A shoulder strap may be inserted through the carrying straps to convert the bag into a shoulder bag. A convenient storage pocket may be provided in the bag to hold the shoulder strap when it is not being used.

Generally, the present invention provides a flexible storage bag comprising:

a main body formed of a flexible material;

an opening formed in a top portion of the main body;

a system for adjusting a size of the opening; and a divider flap formed of a flexible material for sealing the opening and for forming two distinct, vertically or horizontally separated, storage areas within the main body.

The present invention further provides a flexible storage bag comprising:

a main body;

an opening formed in a top portion of the main body;

a system for adjusting a size of the opening, the adjusting system including a hem formed about a peripheral top edge of the main body of the bag, and a drawstring disposed within the hem;

a flap for sealing the opening; and a system for securing the flap across the opening, the securing system including at least one connector positioned on a top surface of the divider flap, and at least one complementary connector positioned on an interior surface of the main body below the hem.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
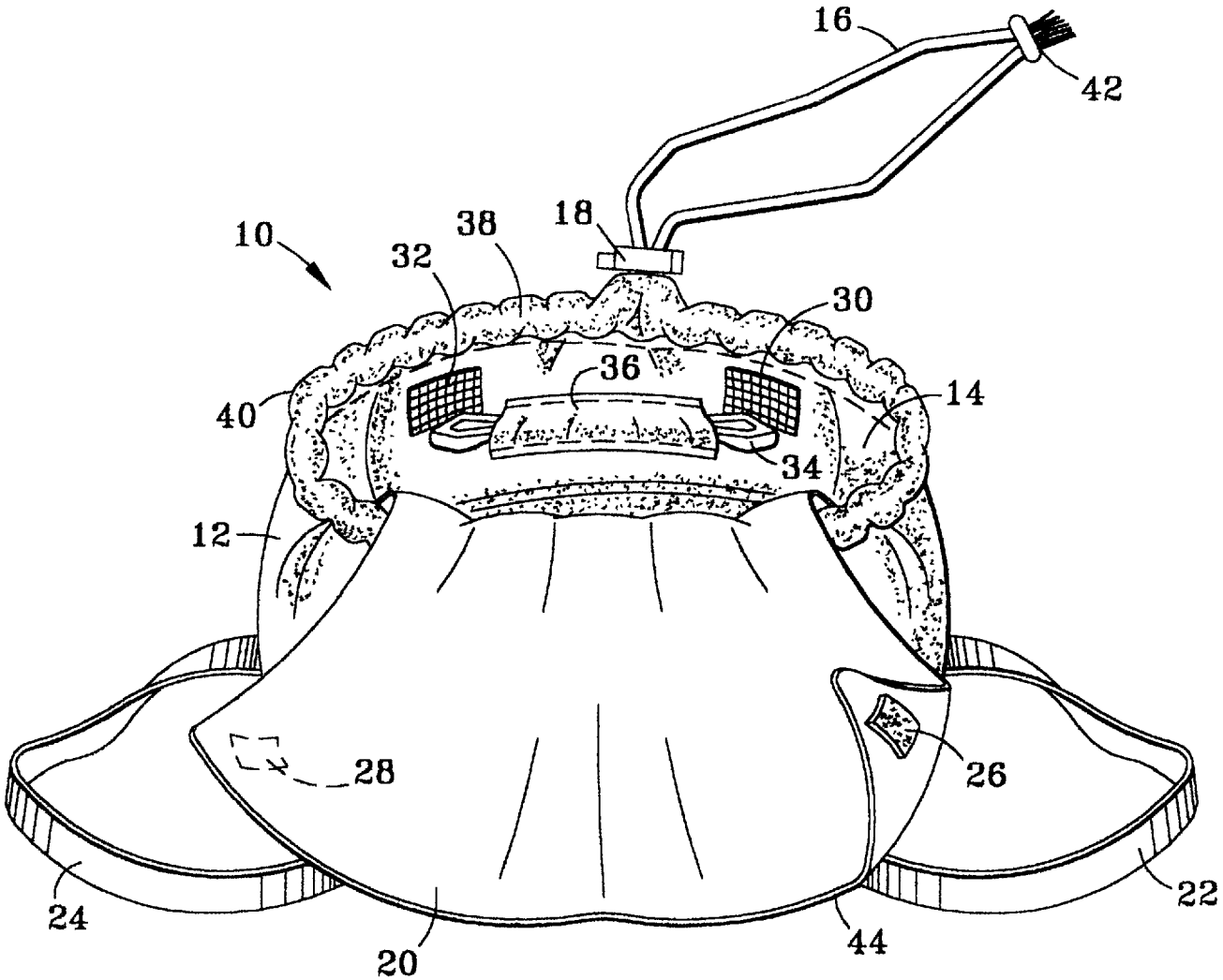
FIG. 1 is a front perspective view of a first embodiment of a flexible storage bag in accordance with the present invention.

The features and advantages of the present invention are illustrated in detail in the accompanying drawings, wherein like reference numerals refer to like elements throughout the drawings.

Referring to FIG. 1, there is illustrated a perspective view of a first embodiment of a flexible storage bag 10 in accordance with the present invention. The flexible storage bag 10 generally comprises a main body 12 having an opening 14 in a top portion thereof. The flexible storage bag further includes a drawstring 16, spring loaded stop 18, divider flap 20, carrying straps 22 and 24, first fasteners 26 and 28, second, complementary fasteners 30 and 32, shoulder carrying strap 34, and shoulder carrying strap storage pocket 36.

The main body 12 of the flexible storage bag 10 is preferably constructed of a light weight, flexible, highly insulative, water repellent, double-faced pile material. Of course, other types of insulating or noninsulating materials may be used to form the flexible storage bag 10 without departing from the intended scope of the present invention as defined in the accompanying claims.

An interior hem 38 is stitched around a peripheral top edge 40 of main body 12 of the flexible storage bag 10. The drawstring 16 is disposed within the hem 38. The ends of the drawstring 16 pass through the spring-loaded stop 18 and are connected by knot 42. The drawstring 16 is used to open and close the flexible storage bag 10. Specifically, to open the bag 10, the spring-loaded stop 18 is unlocked and moved along the drawstring 16 towards the knot 42. The peripheral top edge 40 of the bag 10 is then free to extend outward, providing a larger opening 14 in the bag 10. To close the bag 10, the spring-loaded stop 18 is unlocked and moved along the drawstring 16 towards the bag 10 until the desired closure is obtained, at which point the spring-loaded stop 18 is again locked holding the bag 10 in a closed position.

Divider flap 20 is also preferably constructed a light weight, flexible, highly insulative, water repellent, double-faced pile material. One edge of divider flap 20 is securely fastened to the hem 38 (e.g., by stitching) to approximately one-half of the circumference of the peripheral top edge 40 of the bag 10. The divider flap 20 is preferably larger than the maximum size of the opening 14, the footprint of the bag 10, or both.

Figure 4:
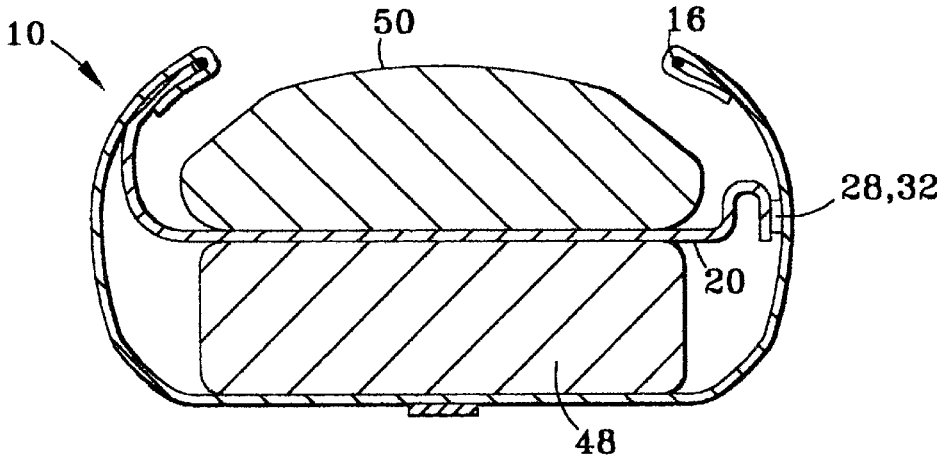
FIG. 4 is a cross-sectional view of the flexible storage bag of FIG. 1, with the flap separating two different containers or objects.
Figure 8:
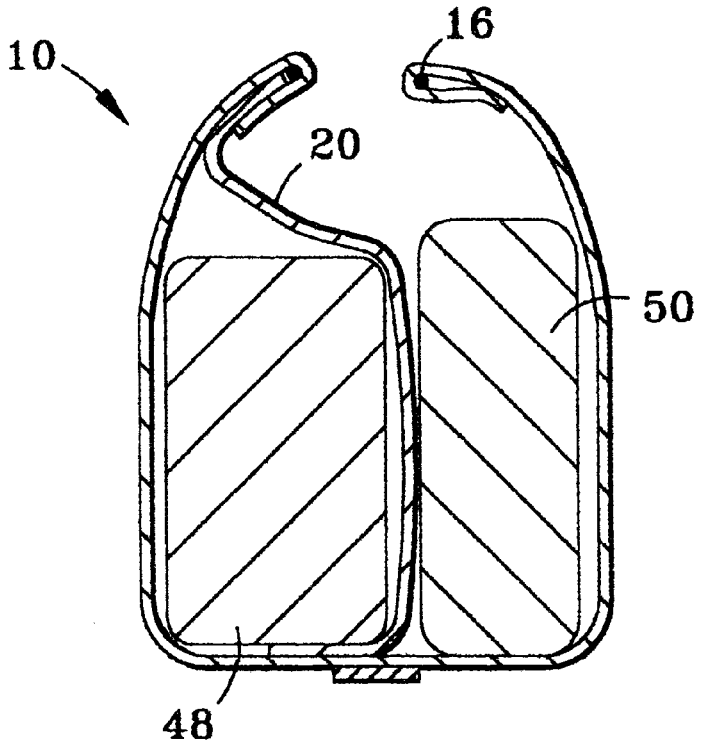
FIG. 8 is another cross-sectional view of the flexible storage bag of FIG. 1, with the flap separating two different containers or objects.
Figure 9:
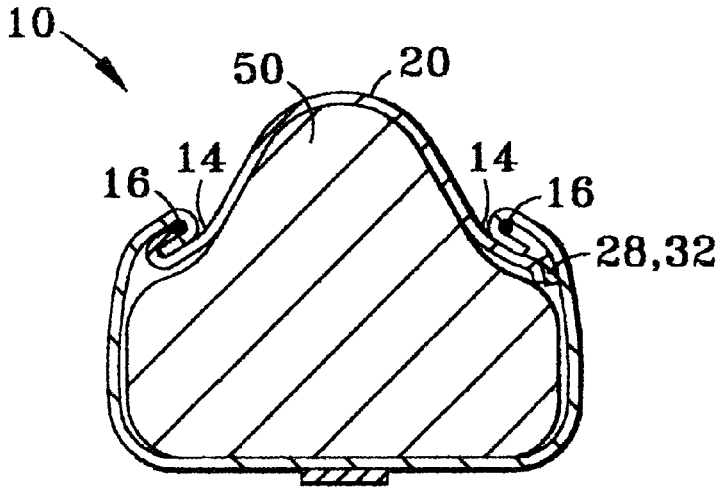
FIG. 9 is a cross-sectional view of the flexible storage bag with the flap covering an object protruding through an opening.

The divider flap 20 provides several important functions. First, the divider flap 20 can function as an insulating cover over hot or cold items contained within bag 10. Second, as illustrated in FIG. 4 and 8, the divider flap 20 can serve as a divider for vertically or horizontally separating, respectively, a plurality of distinct containers or objects enclosed within the bag 10. Third, because of the large relative size of the divider flap 20, the effective storage area within the flexible storage bag 10 is increased. For example, as shown in FIG. 9, the divider flap 20 can be used to cover a top portion of a container or object 50 which protrudes through the opening 14.

Figure 2:
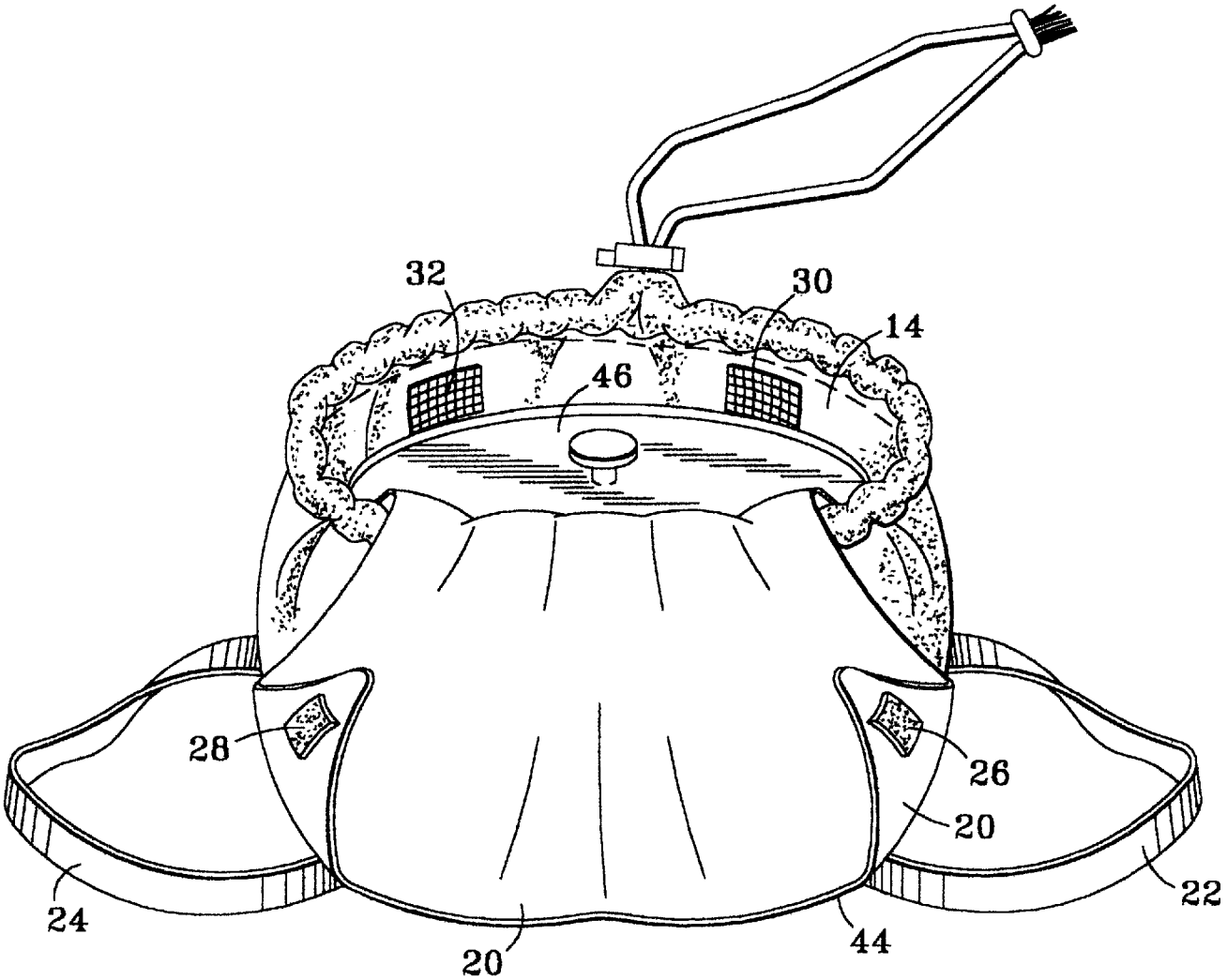
FIG. 2 is a perspective view of the flexible storage bag of FIG. 1, with a covered container received therein.

A plurality of fasteners 26 and 28 are located near a peripheral edge 44 of the divider flap 20. A corresponding plurality of complementary fasteners 30 and 32 are mounted on the interior surface of the bag 10 beneath the peripheral top edge 40 and the hem 38. The fasteners 26, 28, and 30, 32, may be secured together to position the divider flap 20 across the opening 14 in the bag 10. As shown in FIGS. 1 and 2, the fasteners 26, 28 are preferably mounted to a top surface of the divider flap 20. In this manner, when the fasteners 26, 28 are attached to the complementary fasteners 30, 32, the peripheral edge 44 of the divider flap 20 is tucked in between the container enclosed within the bag 10 and the inside surface of the bag 10, thereby maximizing the insulating properties of the bag 10 (see also FIG. 4). Many types of fastening systems, such as hook/loop fasteners, snaps, buttons, clips, zippers, or the like, may be used to secure the divider flap 20 over the opening 14.

The shoulder carrying strap 34 may be stored within the bag 10 in the shoulder carrying strap storage pocket 36. The shoulder carrying strap storage pocket 36 is preferably formed of a section of a flexible fabric material which is stitched on two sides to an interior surface of bag 10. The shoulder carrying strap storage pocket 36 may be imprinted with a product and/or identification label.

FIG. 2 is a perspective view of the flexible storage bag 10 showing a covered container 46 received within the opening 14 of the bag 10. Also, in FIG. 2, the divider flap 20 is in the process of being secured over the covered container 46.

Figure 3:
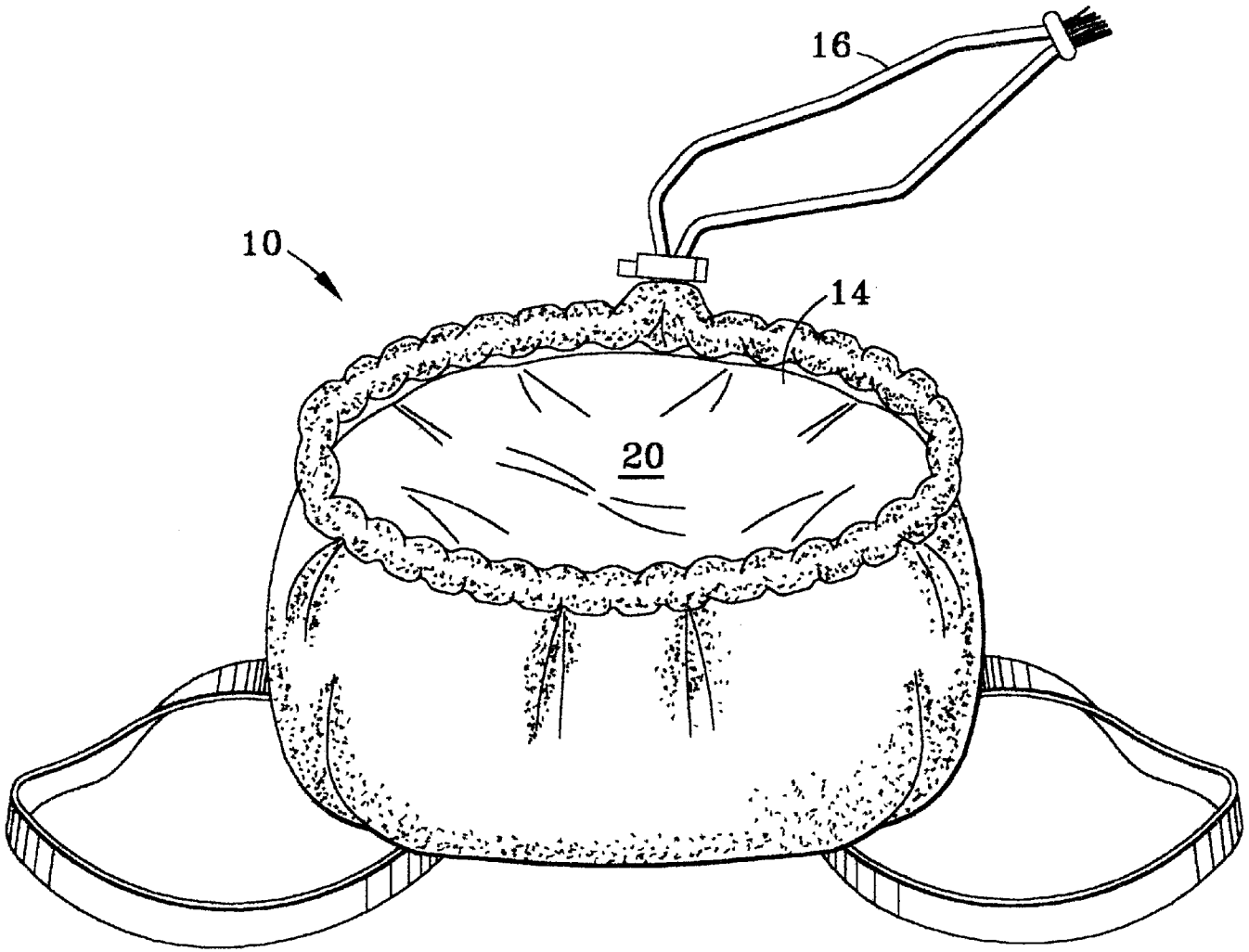
FIG. 3 is a perspective view of the flexible storage bag of FIG. 2, wherein the container is covered by the flap.

FIG. 3 is a perspective view of the flexible storage bag 10 showing the divider flap 20 secured over, and fully covering, the top of covered container 46. At this point, the drawstring 16 may be tightened as detailed above to reduce the diameter of the opening 14, thereby substantially surrounding the covered container 46 with insulating material. Accordingly, the contents of the covered container 46 will be kept hot or cold for an extended period of time. In this first embodiment of the flexible storage bag 10, the divider flap 20 forms the top cover of the flexible storage bag 10.

FIG. 4 is a cross-sectional view of the flexible storage bag 10 showing the divider flap 20 being used to separate a plurality of containers or objects 48 and 50 within the bag 10. After the first container 48 has been placed within the flexible storage bag 10, the divider flap 20 is secured over the first container 48 as described above. Thereafter, the second container 50 may be placed on top of the divider flap 20. The drawstring 16 may then be tightened to close the flexible storage bag 10 around both containers 48, 50. A similar scenario, wherein the divider flap 20 is used to horizontally separate first and second containers 48, 50 within the flexible storage bag 10, is illustrated in FIG. 8. In this case, the peripheral edge 44 of the divider flap 20 can be tucked between the containers or under one of the containers.

Due to the insulative properties of the divider flap 20, the divider flap 20 can be used to separate containers containing hot and cold food. Further, since the divider flap 20 is preferably formed of a water-repellent material, the divider flap 20 can be used to separate wet and dry items within the flexible storage bag 10. In addition, the divider flap 20 can be used to separate a container from a plurality of items such as plates, cups, and utensils.

Figure 5:
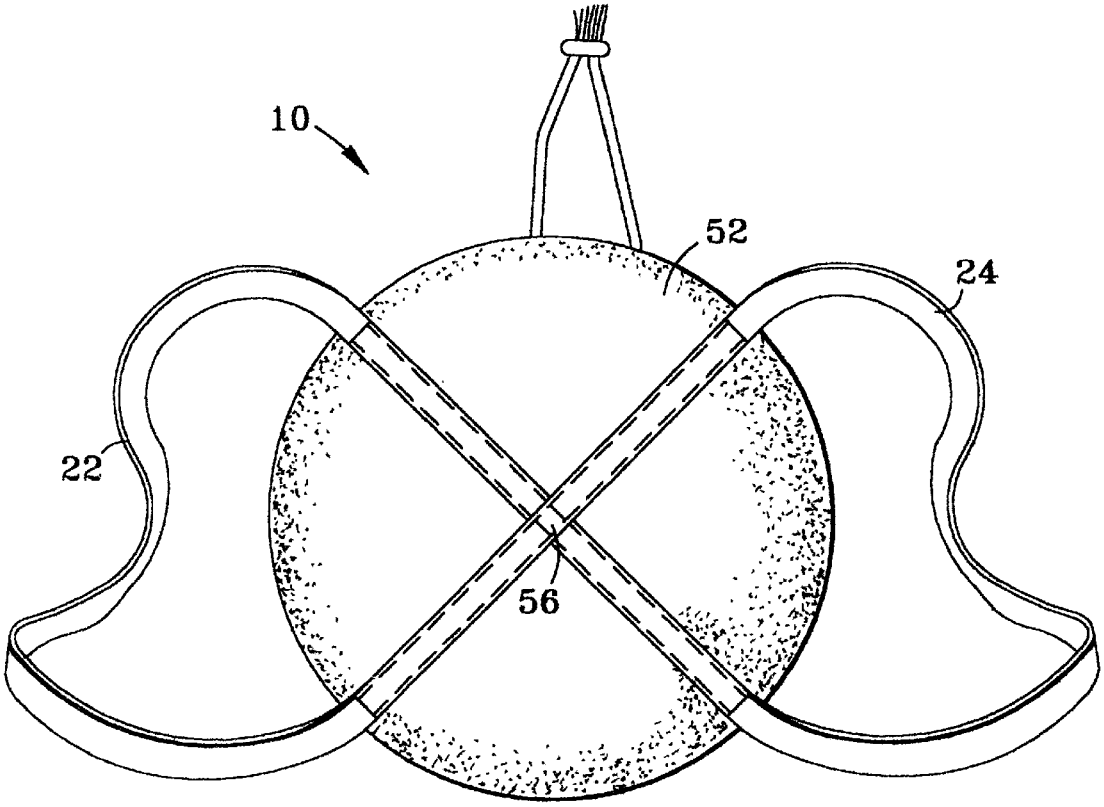
FIG. 5 is a bottom perspective view of the flexible bag illustrating the crossed configuration and securement of the carrying straps on the bottom of the bag.

FIG. 5 is a bottom perspective view of the flexible storage bag 10 illustrating the crossed configuration and securement of the carrying straps 22 and 24 on the bottom of the bag 10. The carrying straps 22 and 24 are formed of fabric, and are stitched onto the outer bottom surface 52 of the bag 10. The carrying straps 22, 24 extend across, and cross underneath, the flexible storage bag 10 and the container(s) enclosed therein, thereby enhancing the strength of the bag 10. The carrying straps 22, 24 are preferably secured on both sides along a portion of their length to the bottom of the bag 10. Also, the carrying straps 22, 24 are secured to each other at their intersection 56 directly under the center of the bag 10. As illustrated in FIG. 5, the carrying straps 22, 24, may be formed using a single length of fabric oriented in a figure-eight.

Figure 6:
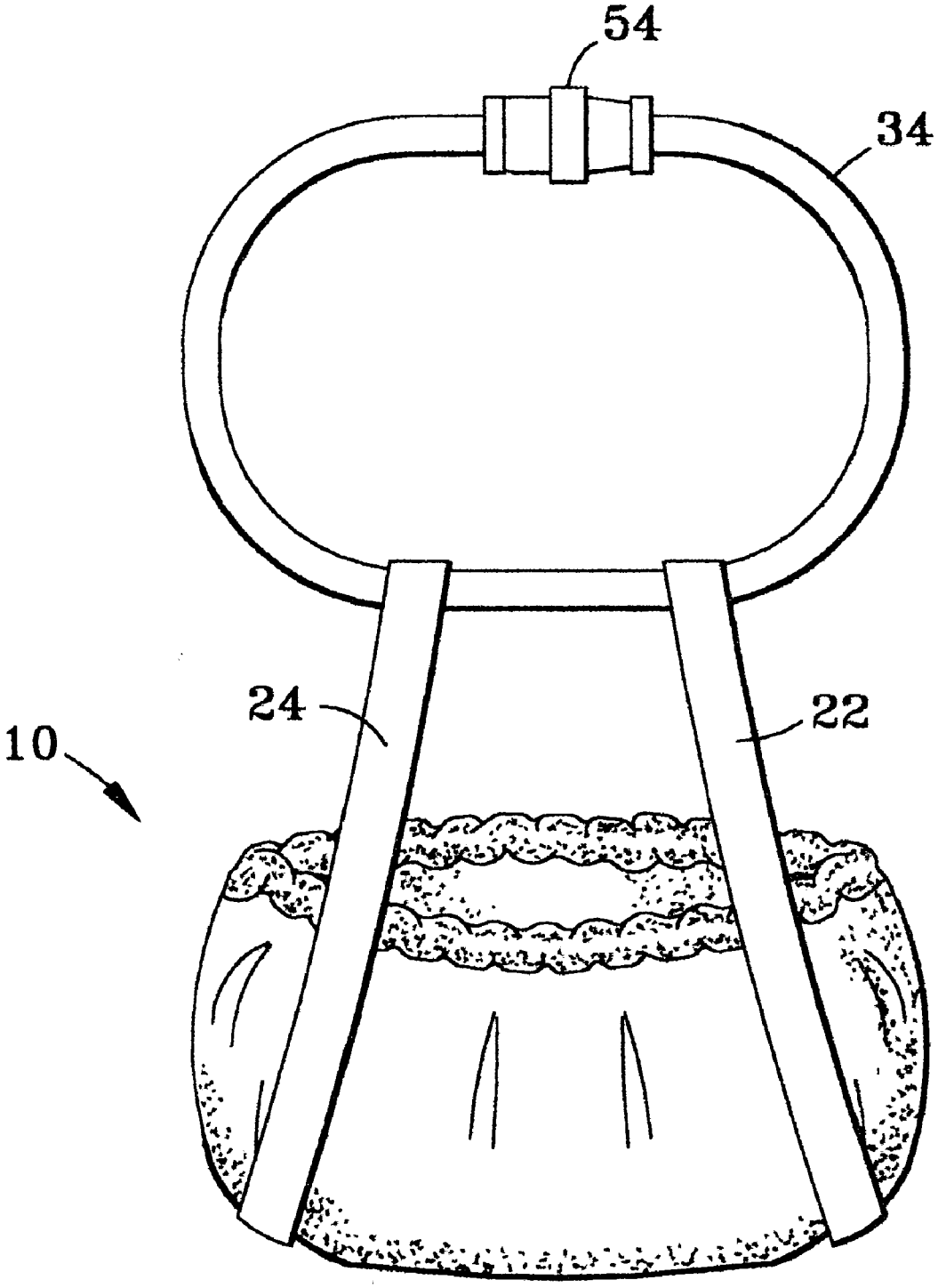
FIG. 6 is a perspective view of another embodiment of a flexible storage bag in accordance with the present invention, wherein a shoulder carrying strap is attached to the carrying straps of the bag.

FIG. 6 illustrates another embodiment of the flexible storage bag 10 whereby a shoulder carrying strap 34 has been linked inside the carrying straps 22 and 24 and connected using a quick release connector 54 to form a continuous loop. The shoulder carrying strap 34 allows a user to support the weight of the flexible storage bag 10 over a shoulder rather than by hand using the carrying straps 22 and 24.

Figure 7:
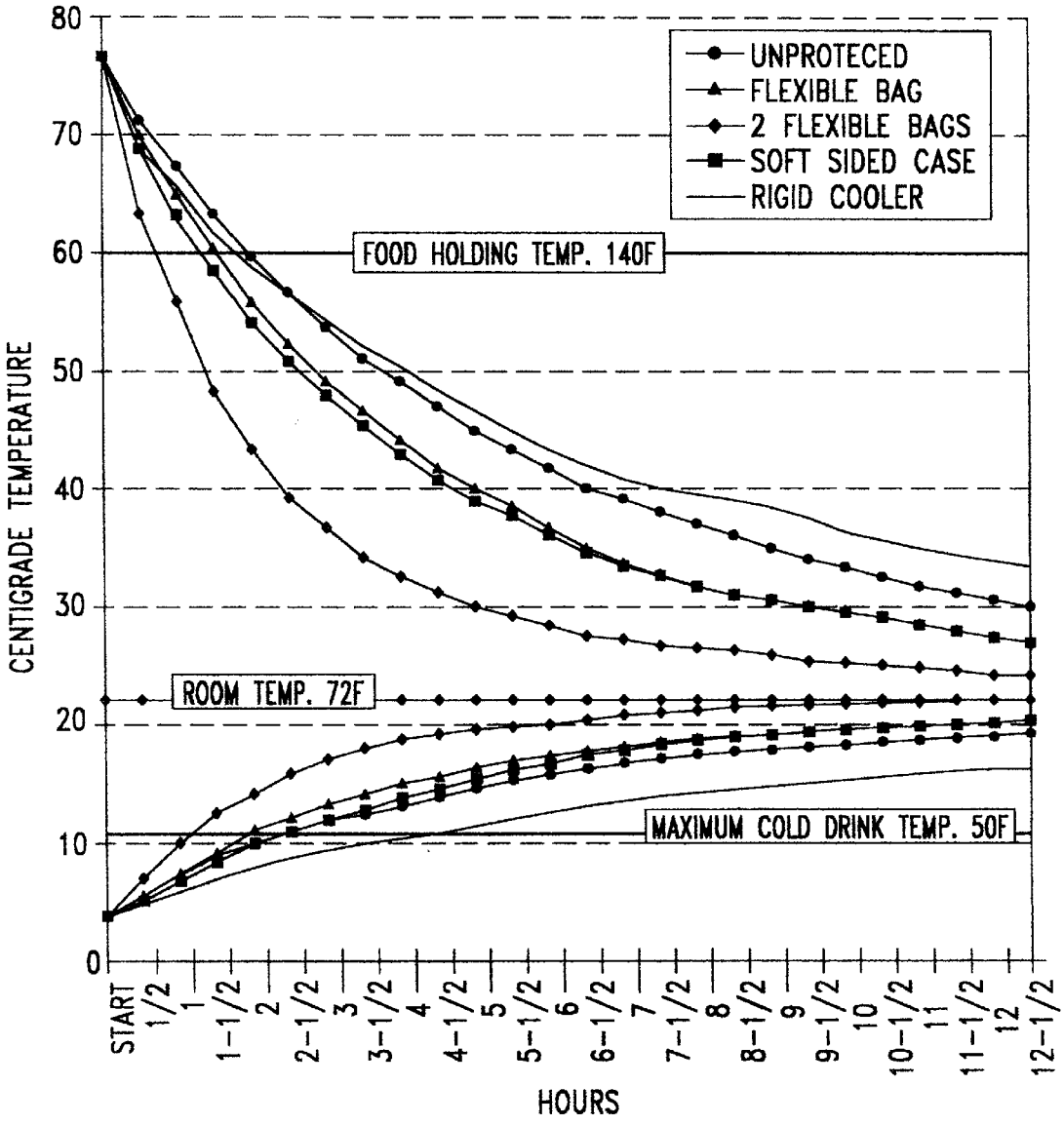
FIG. 7 is a graph of the temperature versus time characteristics of the flexible storage bag with an initially hot object and with an initially cold object contained within.

In order to prove quantitatively, the insulating benefits of the flexible storage bag of the present invention fabricated from an insulating double-faced pile material, experimental tests were conducted. FIG. 7 illustrates the temperature versus time characteristics of the flexible storage bag compared with a soft sided commercially available cooler, a rigid sided commercially available cooler, and without any insulating container whatsoever. In FIG. 7, data points associated with the flexible storage bag of the present invention are denoted by triangular shaped symbols. Another case is shown whereby one flexible storage bag of the present invention is placed inside a second, identical flexible storage bag. The corresponding data points for this case in FIG. 7 are denoted by round shaped symbols.

For each test, a 3 quart glass rectangular container was filled with 2 quarts of water and was covered with a plastic lid. Then the glass container was placed inside the insulating container being tested and, using thermometers protruding from the insulating container to allow the temperatures to be read without opening the container, the water temperature was measured over a period of time. The test results showing the water temperature versus time, for the various insulating containers tested, are shown in FIG. 7. For comparison purposes, baseline test results for the glass container filled with water and without being inside any insulating container are included in FIG. 7. Initially the water in the glass container was either hot or cold and the outside of the insulating container was at room temperature.

In the first test, the hot water within the glass container was initially at a temperature of 77° C. As can be seen from the graph in FIG. 7, the single flexible bag provides significant improvements in slowing the loss of heat from the water. Furthermore, the use of two flexible storage bags provides heat retaining properties almost as good as a rigid cooler.

In the second test, the water temperature of the water in the glass container was initially at a temperature of 4° C. As can be seen from the graph in FIG. 7, the single flexible storage bag provides significant improvements in slowing the temperature rise of the water.

The foregoing description of the present invention has been presented for purposes of illustration and description. It is not intended to be exhaustive or to limit the invention to the precise form disclosed, and many modifications and variations are possible in light of the above teaching. For example, hot or cold packs may be inserted into the flexible storage bag 10 to heat or cool a container stored therein. Such modifications and variations that may be apparent to a person skilled in the art are intended to be included within the scope of this invention as defined by the accompanying claims.

We claim:

1. A flexible storage bag comprising:

a main body formed of a flexible material;

an opening formed in a top portion of the main body;

a system for adjusting a size of the opening;

a divider flap formed of a flexible material for sealing the opening and for forming two distinct, vertically or horizontally separated, storage areas within the main body;

a plurality of carrying straps attached to the main body; and a shoulder strap, insertable through each carrying strap, and a storage pocket, located within the main body, for storage of the shoulder strap when not in use.

2. The flexible storage bag according to claim 1, wherein the main body of the bag is formed from a light weight, flexible, highly insulative, water repellent, double-faced pile material.

3. The flexible storage bag according to claim 1, wherein the system for adjusting a size of the opening comprises a drawstring.

4. The flexible storage bag according to claim 3, further including a hem formed about a peripheral top edge of the main body of the bag, wherein the drawstring is disposed within the hem.

5. The flexible storage bag according to claim 1, wherein the divider flap is formed from a light weight, flexible, highly insulative, water repellent, double-faced pile material.

6. The flexible storage bag according to claim 1, further including a system for securing the divider flap across the opening.

7. The flexible storage bag according to claim 6, wherein the securing system comprises at least one connector positioned on a top surface of the divider flap, and at least one complementary connector positioned within the main body of the bag.

8. The flexible storage bag according to claim 1, wherein a central portion of the divider flap protrudes through the opening to expand the effective storage area of the bag.

9. A flexible storage bag comprising:

a main body;

an opening formed in a top portion of the main body;

a system for adjusting a size of the opening, the adjusting system including a hem formed about a peripheral top edge of the main body of the bag, and a drawstring disposed within the hem;

a flap for sealing the opening;

a system for securing the flap across the opening, the securing system including at least one connector positioned on a top surface of the flap, and at least one complementary connector positioned on an interior surface of the main body below the hem; and wherein the main body and the flap are formed from a light weight, flexible, highly insulative, water repellent, double-faced pile material.

10. The flexible storage bag according to claim 9, further comprising a plurality of carrying straps attached to the main body.

11. The flexible storage bag according to 10, wherein the carrying straps extend across, and cross underneath, a bottom surface of the main body.

12. The flexible storage bag according to claim 10, further including a shoulder strap, insertable through each carrying strap, and a storage pocket, located within the main body, for storage of the shoulder strap when not in use.

13. The flexible storage bag according to claim 9, wherein an edge portion of the flap is secured to approximately one-half of the circumference of the peripheral top edge of the main body.

14. The flexible storage bag according to claim 13, wherein the edge portion of the flap is secured below the opening to an inside surface of the peripheral top edge of the main body.

15. A flexible storage bag comprising:

a main body formed of a flexible material;

an opening formed in a top portion of the main body;

a system for adjusting a size of the opening; and a divider flap formed of a flexible material for sealing the opening and for forming two distinct, vertically or horizontally separated, storage areas within the main body;

wherein an edge of the divider flap is secured to about one-half of a circumference of a peripheral top edge of the main body.

16. The flexible storage bag according to claim 15, wherein the main body of the bag and the divider flap are formed from a light weight, flexible, highly insulative, water repellent, double-faced pile material.

17. The flexible storage bag according to claim 15, wherein the system for adjusting a size of the opening comprises a drawstring.

18. The flexible storage bag according to claim 15, further including a system for securing the divider flap across the opening.

* * * * *

UNITED STATES PATENT AND TRADEMARK OFFICE

CERTIFICATE OF CORRECTION

PATENT NO. : 5,988,879

DATED : November 23, 1999

INVENTOR(S) : Bredderman et al.

It is certified that error appears in the above-identified patent and that said Letters Patent is hereby corrected as shown below:

Please correct the legend in Figure 7 as follows:
"Unprotected" should be preceded by a diamond -- ♦ --.
"2 Flexible Bags" should be preceded by a circle -- ● --.

Signed and Sealed this

Sixth Day of March, 2001

*Attest:*

Nicholas P. Godici

NICHOLAS P. GODICI

*Attesting Officer*

*Acting Director of the United States Patent and Trademark Office*